US008477159B2

(12) United States Patent
Ichikura

(10) Patent No.: US 8,477,159 B2
(45) Date of Patent: Jul. 2, 2013

(54) OFFSET CANCEL OUTPUT CIRCUIT OF SOURCE DRIVER FOR DRIVING LIQUID CRYSTAL DISPLAY

(75) Inventor: Hiroyoshi Ichikura, Ibaraki (JP)

(73) Assignee: Lapis Semiconductor Co., Ltd. (JP)

( * ) Notice: Subject to any disclaimer, the term of this patent is extended or adjusted under 35 U.S.C. 154(b) by 105 days.

(21) Appl. No.: 13/236,356

(22) Filed: Sep. 19, 2011

(65) Prior Publication Data

US 2012/0069058 A1 Mar. 22, 2012

(30) Foreign Application Priority Data

Sep. 21, 2010 (JP) ..... 2010-210627

(51) Int. Cl.
*G09G 5/10* (2006.01)
*G09G 3/36* (2006.01)

(52) U.S. Cl.
USPC ..... 345/690; 345/98

(58) Field of Classification Search
USPC ..... 345/690, 87, 89, 211, 174, 212, 98, 345/77, 205
See application file for complete search history.

(56) References Cited

U.S. PATENT DOCUMENTS

2009/0278868 A1* 11/2009 Nakahira et al. ..... 345/690
2010/0033458 A1* 2/2010 Shimizu et al. ..... 345/211

FOREIGN PATENT DOCUMENTS

JP 11-044872 2/1999
JP 2001-067047 A 3/2001

* cited by examiner

*Primary Examiner* — Michael Faragalla
(74) *Attorney, Agent, or Firm* — Studebaker & Brackett PC

(57) ABSTRACT

An offset cancel output circuit of source drivers for driving liquid crystal displays which is capable of appropriately cancelling out an offset voltage from an output amplifier to thereby prevent degradation in display quality. The offset cancel output circuit includes an operational amplifier with a non-inverted input port to which a reference voltage is applied, and an input capacitor and an output capacitor with each one end thereof connected to an inverted input port of the operational amplifier. The offset cancel output circuit further includes a switching element circuit which has a first field effect transistor connected between the inverted input port and an output port of the operational amplifier and controlled to turn on during a reset operation. During the reset operation and the normal output operation, a first potential equal to the reference voltage is applied to the substrate of the first field effect transistor.

8 Claims, 7 Drawing Sheets

OFFSET CANCEL OUTPUT CIRCUIT OF SOURCE DRIVER FOR DRIVING LIQUID CRYSTAL DISPLAY

BACKGROUND OF THE INVENTION

1. Field of the Invention

The present invention relates to an offset cancel output circuit of a source driver for driving a liquid crystal display.

2. Description of the Related Art

Source drivers for driving a liquid crystal display panel function to cancel an offset component in the drive voltage delivered from an output circuit that includes an operational amplifier (see Japanese Patent Kokai No. H11-044872 (Patent Literature 1) and Japanese Patent Kokai No. 2001-67047 (Patent Literature 2)). FIG. 1 shows the configuration of the conventional offset cancel output circuit that is disclosed in Patent Literature 2. This offset cancel circuit is a capacitor-coupled operational amplifier circuit, which includes an output amplifier 1, an input capacitor Cin, an output capacitor Cout, switching elements SW1 to SW6, and a resistor R1. Furthermore, the offset cancel output circuit is supplied with a reference voltage VOP and a voltage VDAC, as an input voltage. The voltage VDAC is a voltage (gray scale voltage) which is obtained by a D/A (digital to analog) converter (not shown) of the source driver converting digital data to an analog voltage, where the digital data is indicative of a gray scale of each pixel supplied to the source driver. The application terminal supplied with the reference voltage VOP is connected to the non-inverted input port of the output amplifier 1 which includes an operational amplifier. The inverted input port of the output amplifier 1 is connected to one end of each of the input capacitor Cin and the output capacitor Cout. The switching element SW1 is connected between the application terminal supplied with the voltage VDAC and the other end of the input capacitor Cin. The switching element SW2 is connected between the application terminal supplied with the reference voltage VOP and the other end of the input capacitor Cin. The switching element SW3 is connected between the non-inverted input port and the inverted input port of the output amplifier 1. The switching element SW4 is connected between the inverted input port and the output port OUT of the output amplifier 1. The switching element SW5 is connected between the other end of the output capacitor Cout and the output port OUT of the output amplifier 1. The switching element SW6 is connected between the other end of the output capacitor Cout and the application terminal supplied with the reference voltage VOP. The resistor R1 is connected at one end thereof to the output port OUT of the output amplifier 1, so that the output voltage of the output amplifier 1 is to be delivered as a drive voltage from a terminal PAD via the resistor R1.

Such a conventional offset cancel output circuit performs a reset operation and a normal output operation. The reset operation is performed in response to an external reset signal in synchronization with the vertical synchronization signal of a video signal. The voltage VDAC is produced in synchronization with the horizontal synchronization signal during the normal output operation.

First, as shown in FIG. 2, during the reset operation, the switching elements SW1 and SW5 are turned OFF, and the switching elements SW 2, SW3, SW 4, and SW6 are turned ON. Thus, the reset operation is carried out by making the voltages at all the connection points (nodes), shown as black circles in FIG. 2, equal to the reference voltage VOP. That is, the reference voltage VOP is applied to the other end of the input capacitor Cin via the switching element SW2, and at the same time, to the other end of the output capacitor Cout via the switching element SW6. Furthermore, the inverted input port and the non-inverted input port of the output amplifier 1 are short-circuited by the switching element SW3, thereby causing an offset voltage ΔV to be produced at the output port of the output amplifier 1. The offset voltage ΔV is supplied to a connection point FB via the switching element SW4. This causes the offset voltage ΔV to be accumulated in each of the input capacitor Cin and the output capacitor Cout, allowing the output circuit to operate with stability under this condition.

Then, as shown in FIG. 3, a transition from the reset operation to the normal output operation causes the switching elements SW1 and SW5 to be turned ON and the switching elements SW 2, SW3, SW 4, and SW6 to be turned OFF. The connection point FB of the inverted input port is floated, and the output amplifier 1 operates so that the connection point FB is held at the reference voltage VOP. That is, this causes electric charges to flow into the input capacitor Cin according to the voltage difference between the reference voltage VOP and the voltage VDAC, also causing charges to flow into the output capacitor Cout according to the voltage difference between the output voltage of the output amplifier 1 and the reference voltage VOP. As such, the output amplifier 1 produces an output voltage with the offset voltage ΔV cancelled. Furthermore, a voltage associated with the voltage VDAC is applied to the inverted input port via the input capacitor Cin, thus allowing a voltage to be delivered according to the voltage difference between the reference voltage VOP and the inverted input port. During the normal output operation, the output voltage of the output amplifier 1 is delivered as a drive voltage during a write period according to the write signal for every one horizontal period to the pixels of the liquid crystal display panel.

SUMMARY OF THE INVENTION

As shown in FIG. 4, in such a conventional offset cancel output circuit, the aforementioned reset and write signals are produced, and during a reset operation, the voltage of the connection point FB at the inverted input port becomes generally equal to the reference voltage VOP (including ΔV) in response to the generation of the reset signal. Upon a transition from the reset operation to a normal output operation, the voltage at the connection point FB is gradually lowered from the reference voltage VOP. This is caused by leakage current to the substrate of the switching element SW4 of a field effect transistor (FET) or leakage current between source and drain. Thus, the reference voltage VOP could not be maintained for a certain length of time at the connection point FB on the inverted input port of the output amplifier 1. This caused the offset voltage component of the output voltage from the output amplifier 1 to increase, leading to deterioration in display quality.

The present invention was developed in view of these problems. It is thus an object of the invention to provide an offset cancel output circuit of a source driver for driving a liquid crystal display and an offset cancelling method, which can appropriately cancel an offset voltage from an output amplifier to prevent degradation in display quality.

The present invention provides an offset cancel output circuit of a source driver to which a gray scale voltage corresponding to a gray scale represented by digital data is applied to output a drive voltage to a liquid crystal display panel. The offset cancel output circuit includes: an operational amplifier with a reference voltage applied to a non-inverted input port; an input capacitor and an output capacitor with each one end thereof connected to an inverted input port of the operational amplifier; and a switching element circuit which has a first field effect transistor connected between the inverted input port and an output port of the operational amplifier. The switching element circuit turns ON the first field effect transistor during a reset operation to make a short circuit between the inverted input port and the output port of the operational amplifier as well as to allow each of the input capacitor and the output capacitor to accumulate an offset voltage. Then, during a normal output operation after the reset operation, the switching element circuit turns OFF the first field effect transistor, applies the gray scale voltage to the other end of the input capacitor, and connects the other end of the output capacitor to the output port of the operational amplifier. During the reset operation and the normal output operation, the switching element circuit applies a first potential equal to the reference voltage to a substrate of the first field effect transistor. When switching the gray scale voltage during the normal output operation, the switching element circuit applies to the substrate a second potential different from the first potential instead of the first potential so as to prevent a leakage current from flowing to the substrate from a source or a drain of the first field effect transistor.

The present invention also provides an offset cancelling method for an output circuit of a source driver for driving a liquid crystal display. The output circuit includes an operational amplifier with a reference voltage applied to a non-inverted input port, an input capacitor and an output capacitor with each one end thereof connected to an inverted input port of the operational amplifier, and a first field effect transistor connected between the inverted input port and an output port of the operational amplifier. The output circuit supplies a gray scale voltage corresponding to a gray scale represented by digital data to output a drive voltage to the liquid crystal display panel. The method includes: turning ON the first field effect transistor during a reset operation to make a short circuit between the inverted input port and the output port of the operational amplifier and allowing each of the input capacitor and the output capacitor to accumulate an offset voltage; turning OFF the first field effect transistor during a normal output operation after the reset operation, applying the gray scale voltage to the other end of the input capacitor, and connecting the other end of the output capacitor to the output port of the operational amplifier; applying a first potential equal to the reference voltage to a substrate of the first field effect transistor during the reset operation and the normal output operation; and applying a second potential different from the first potential to the substrate instead of the first potential, when switching the gray scale voltage during the normal output operation, so as to prevent a leakage current from flowing to the substrate from a source or a drain of the first field effect transistor.

According to the offset cancel output circuit and the offset canceling method of the present invention, the second potential different from the first potential is applied to the substrate instead of the first potential so as to prevent a leakage current from flowing through the substrate from the source or the drain of the first field effect transistor when switching the gray scale voltage. This makes it possible to hold the potential of the inverted input port at the reference voltage to prevent a leakage current from flowing to the substrate from the source or the drain of the first field effect transistor, thereby minimizing output voltage offsets. It is thus possible to prevent degradation in display quality by appropriately canceling the offset voltage of the operational amplifier.

DETAILED DESCRIPTION OF THE INVENTION

Now, the present invention will be described below in more detail with reference to the accompanying drawings in accordance with the embodiments.

Figure 1:
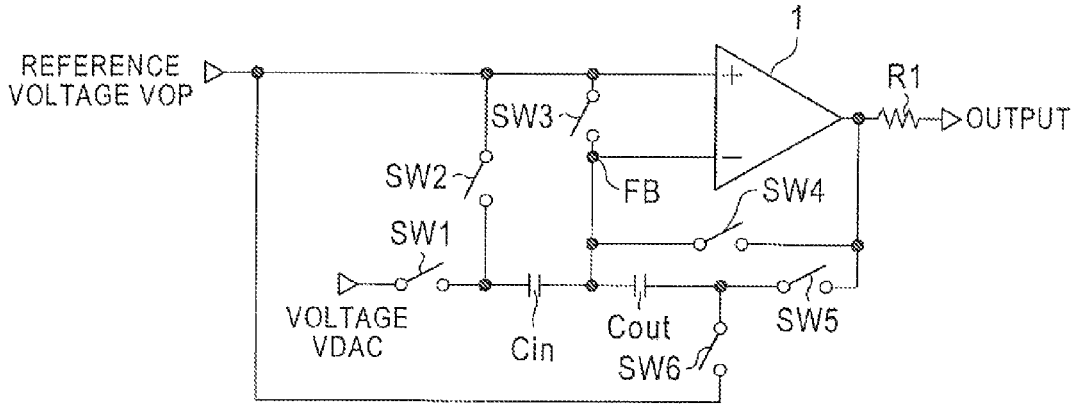
FIG. 1 is a block diagram illustrating the configuration of a conventional offset cancel output circuit.
Figure 2:
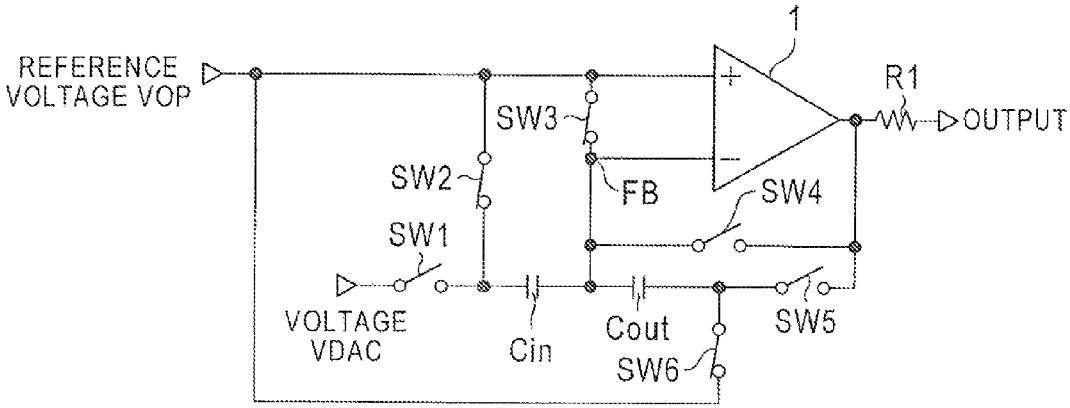
FIG. 2 is a view illustrating the switching elements being turned ON and OFF during a reset operation in the circuit of FIG. 1.
Figure 3:
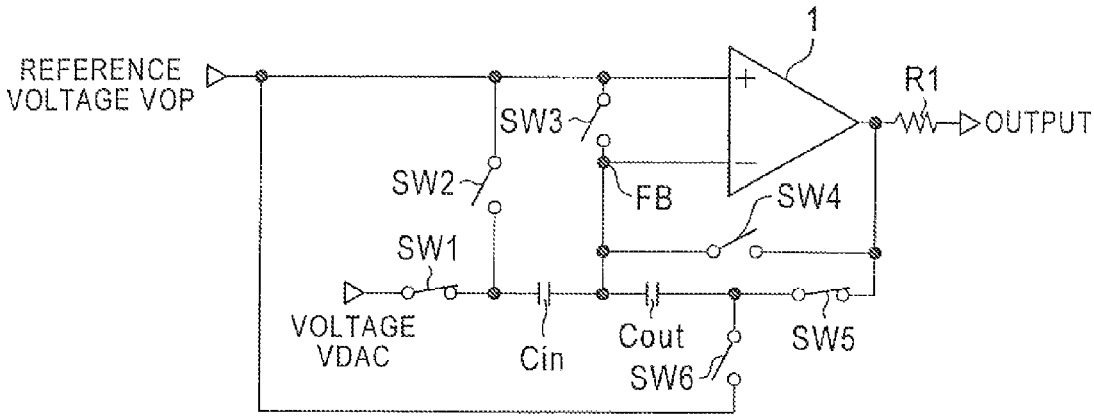
FIG. 3 is a view illustrating the switching elements being turned ON and OFF during a normal output operation in the circuit of FIG. 1.
Figure 4:
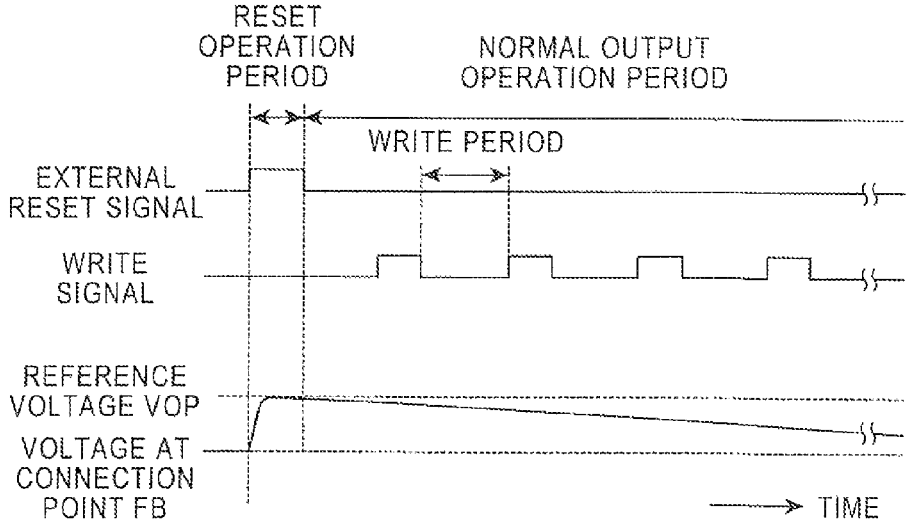
FIG. 4 is a view illustrating changes in voltage of an external reset signal, a write signal, and a connection point FB in the circuit of FIG. 1.
Figure 5:
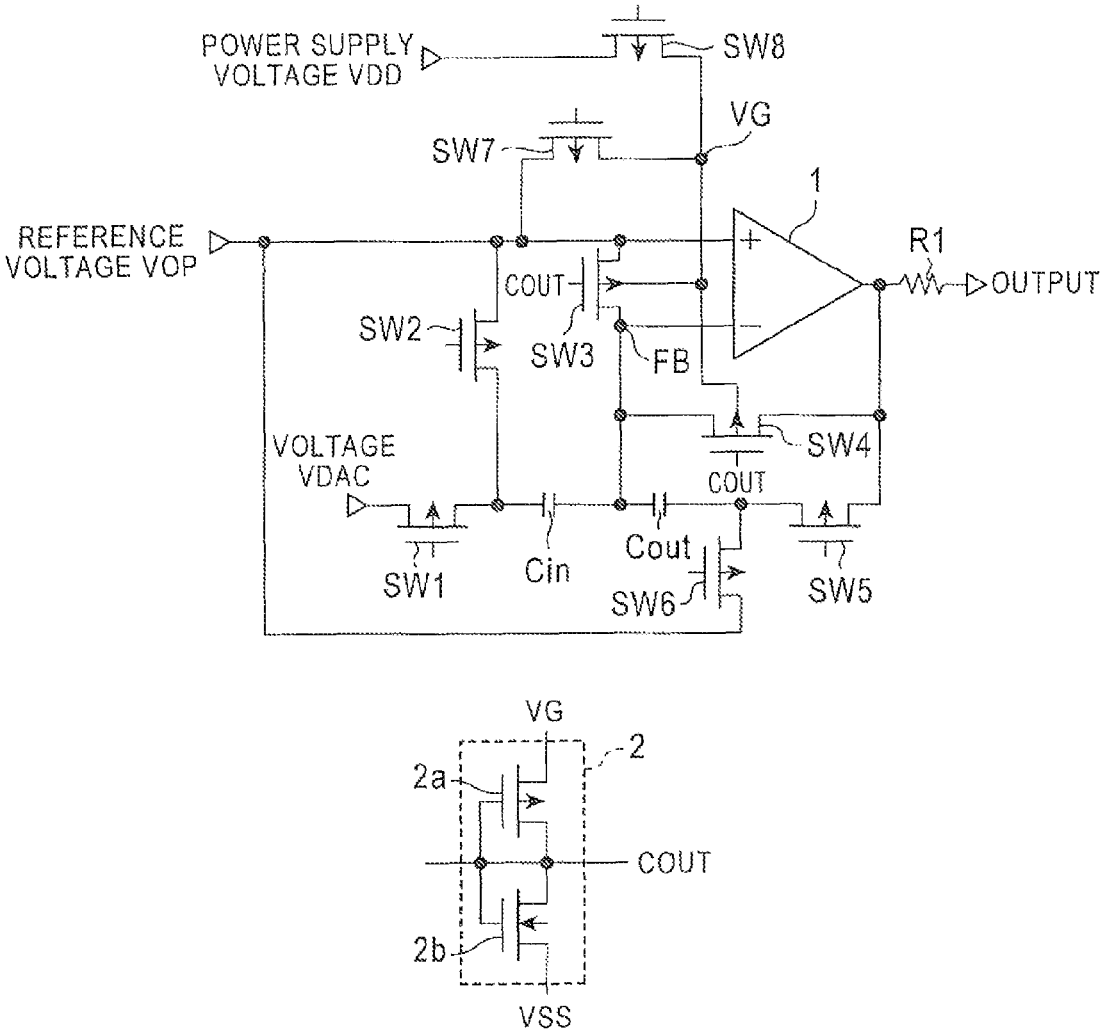
FIG. 5 is a block diagram illustrating the configuration of an offset cancel output circuit according to an embodiment of the present invention.

FIG. 5 shows the configuration of an offset cancel output circuit according to an embodiment of the present invention. This offset cancel output circuit includes switching elements SW7 and SW8 which have been added to the configuration of the conventional offset cancel output circuit of FIG. 1. In the present offset cancel output circuit, the switching elements SW1 to SW8 are a P-channel FET. Note that the switching element SW4 is equivalent to the first field effect transistor, and the switching element SW3 is equivalent to the second field effect transistor.

The switching element SW7 is connected between the application terminal of the reference voltage VOP and the substrate (or the back gate) of each of the switching elements SW3 and SW4, this connection point to the substrate being referred to as VG. The switching element SW8 is connected between the application terminal of a power supply voltage VDD and the connection point VG between the substrates of each of the switching elements SW3 and SW4. The power supply voltage VDD is applied to the substrate of the switching elements SW1, SW2, and SW5 to SW8.

Furthermore, the gate of each of the switching elements SW3 and SW4 is supplied with a control signal CONT from an inverter 2. The inverter 2 is made up of two FETs 2*a* and 2*b* in a complementary structure. The source of the P-channel FET 2*a* is connected to the connection point VG. The source of the N-channel FET 2*b* is supplied with a reference potential (ground potential) VSS. The FETs 2*a* and 2*b* output the control signal CONT from the respective drain.

Note that in this embodiment, the supply voltage VDD is 18 V, the reference voltage VOP is 3 V, the ground potential VSS is 0 V, and the voltage VDAC is 0 to 18 V.

Like the conventional circuit, the offset cancel output circuit configured in the aforementioned manner may perform the reset operation and the normal output operation. The reset operation is carried out in response to an external reset signal in synchronization with the vertical synchronization signal of a video signal.

Figure 6:
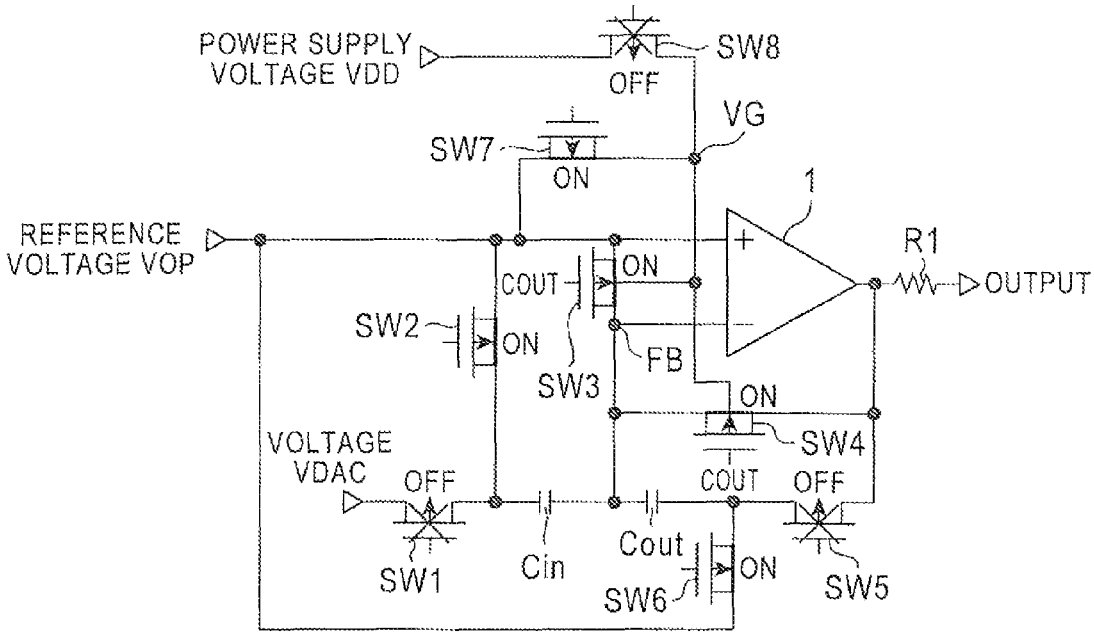
FIG. 6 is a view illustrating the switching elements being turned ON and OFF during a reset operation in the circuit of FIG. 5.

First, as shown in FIG. 6, the reset operation causes the switching elements SW1, SW5, and SW8 to be turned OFF and the switching elements SW2, SW3, SW4, SW6, and SW7 to be turned ON. Accordingly, the reference voltage VOP is applied to the other end of the input capacitor Cin via the switching element SW2 as well as to the other end of the output capacitor Cout via the switching element SW6. Furthermore, since the inverted input port and the non-inverted input port of the output amplifier 1 are short circuited by the switching element SW3, the offset voltage ΔV is produced at the output port of the output amplifier 1. This offset voltage ΔV is supplied to the connection point FB via the switching element SW4. This causes the offset voltage ΔV to be accumulated in each of the input capacitor Cin and the output capacitor Cout, thereby allowing the output circuit to operate with stability.

Figure 7:
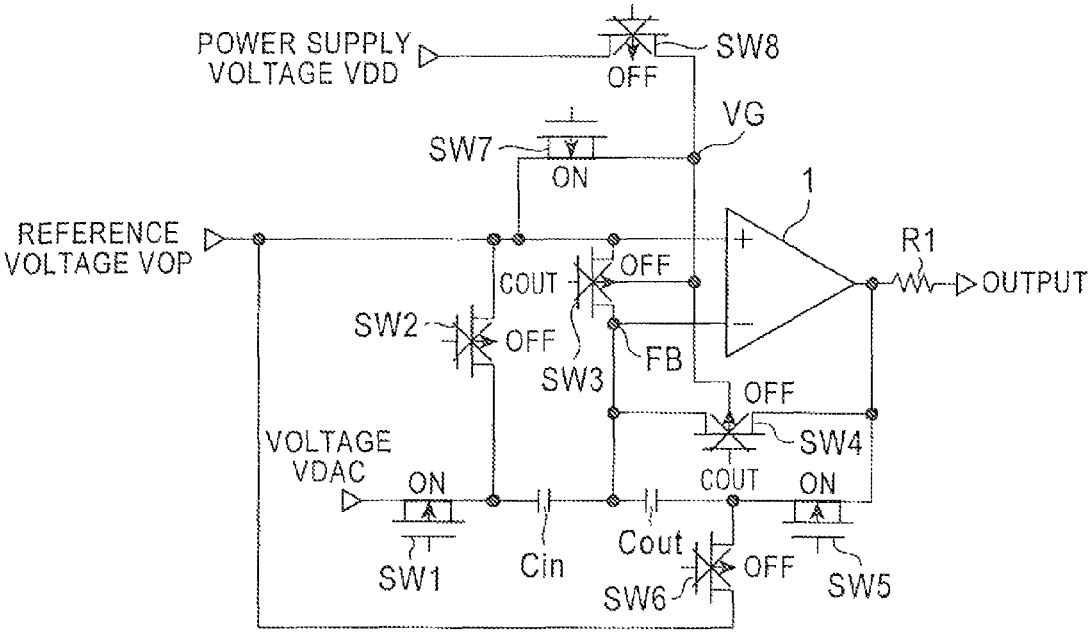
FIG. 7 is a view illustrating the switching elements being turned ON and OFF during a normal output operation in the circuit of FIG. 5.

Then, as shown in FIG. 7, a transition from the reset operation to the normal output operation causes the switching elements SW1, SW5, and SW7 to be turned ON and the switching elements SW2, SW3, SW4, SW6, and SW8 to be turned OFF. The connection point FB of the inverted input port is floated, causing the output amplifier 1 to operate so that the voltage at the connection point FB is maintained at the reference voltage VOP. That is, the input capacitor Cin is supplied with electric charges according to the voltage difference between the reference voltage VOP and the voltage VDAC, whereas the output capacitor Cout is supplied with charges according to the voltage difference between the output voltage of the output amplifier 1 and the reference voltage VOP. This allows an output voltage with the offset voltage ΔV canceled to be produced from the output amplifier 1. During the normal output operation, the output voltage of the output amplifier 1 is delivered to the liquid crystal display panel as a drive voltage by a switching element (not shown) that is turned ON during a write period in response to the write signal in each one horizontal period. This allows the drive voltage to be retained as the write voltage for the corresponding pixel in the liquid crystal display panel.

Figure 8:
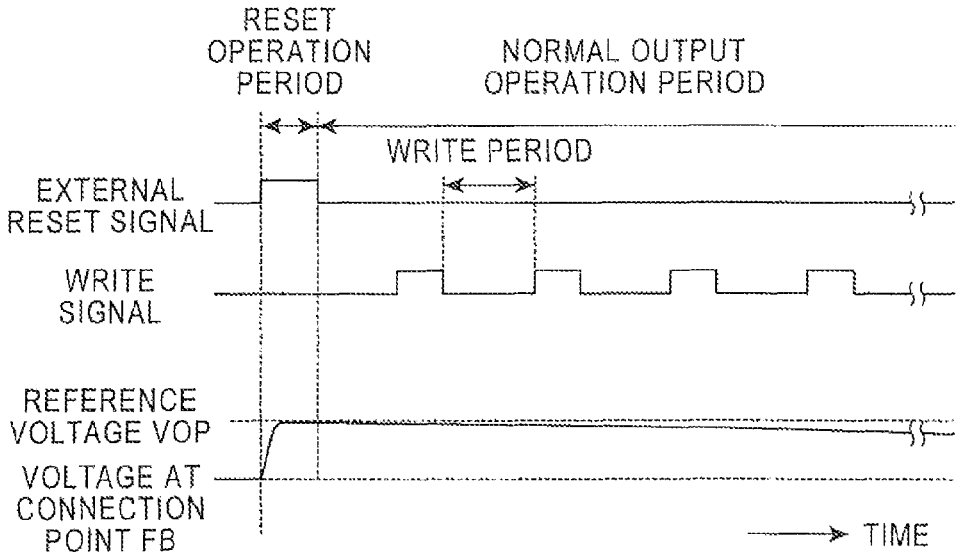
FIG. 8 is a view illustrating changes in voltage of an external reset signal, a write signal, and a connection point FB in the circuit of FIG. 5.

During the normal output operation period and the reset operation period, the switching element SW7 is turned ON and the switching element SW8 is turned OFF. This allows for applying the reference voltage VOP to the line of the connection point VG via the switching element SW7, resulting in the potential of the connection point VG being fixed to the reference voltage VOP. Accordingly, the potential difference between the connection point FB and the connection point VG is eliminated, allowing the leakage current to the substrate to be reduced at the switching element SW4. As shown in FIG. 8, it is thus possible to prevent variations in the reference voltage VOP at the connection point FB.

Depending on the range of variations in voltage resulting from changes in the level of the voltage VDAC during the normal operation period (i.e., when the voltage at the output port OUT varies), the coupling between the input capacitor Cin and the output capacitor Cout can cause a significant variation in the voltage level at the connection point FB. This may cause a PN forward current to flow between the source or the drain of each of the switching elements SW3 and SW4 and the connection point VG, leading to the occurrence of a large leakage current. As a result, for example, as shown at Portion "A" in FIG. 10, the voltage at the connection point FB may drop due to a change in voltage at the output port OUT.

Figure 9:
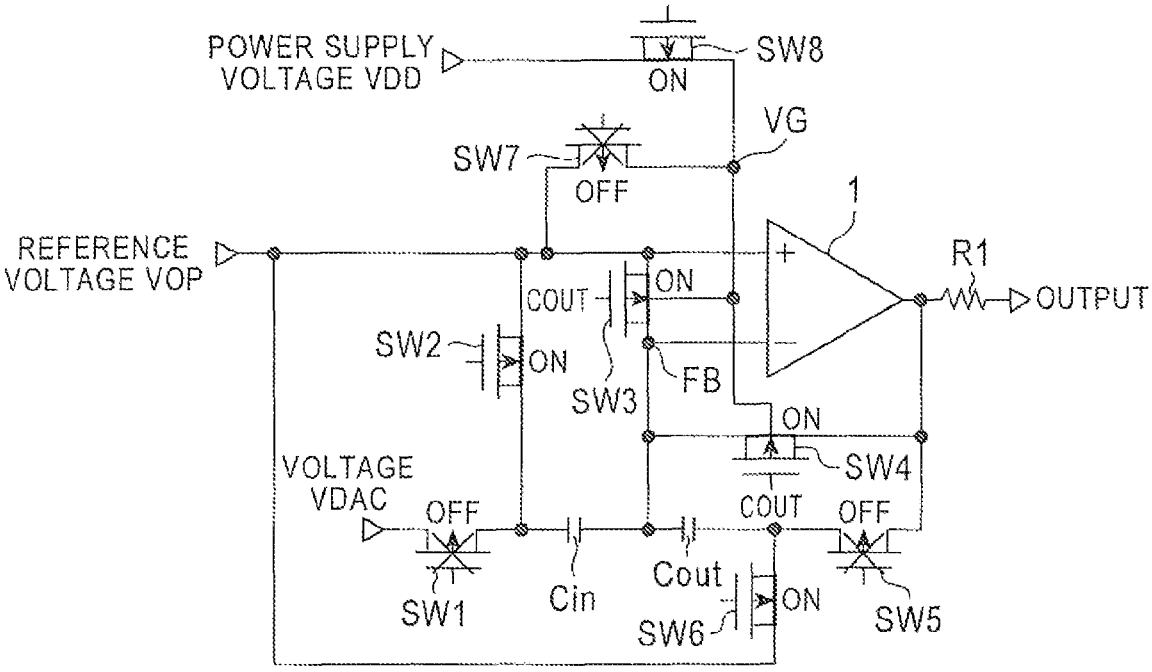
FIG. 9 is a view illustrating the switching elements being turned ON and OFF while a reset operation is switched to a normal output operation in the circuit of FIG. 5.

In contrast to this, as shown in FIG. 9, a change in the level of the voltage VDAC during the normal output operation period causes the switching element SW7 to be turned OFF and the switching element SW8 to be turned ON. More specifically, as shown in FIG. 10, the switching element SW7 is held OFF and the switching element SW8 is held ON for a predetermined time from the occurrence of a write signal (pulse).

Figure 10:
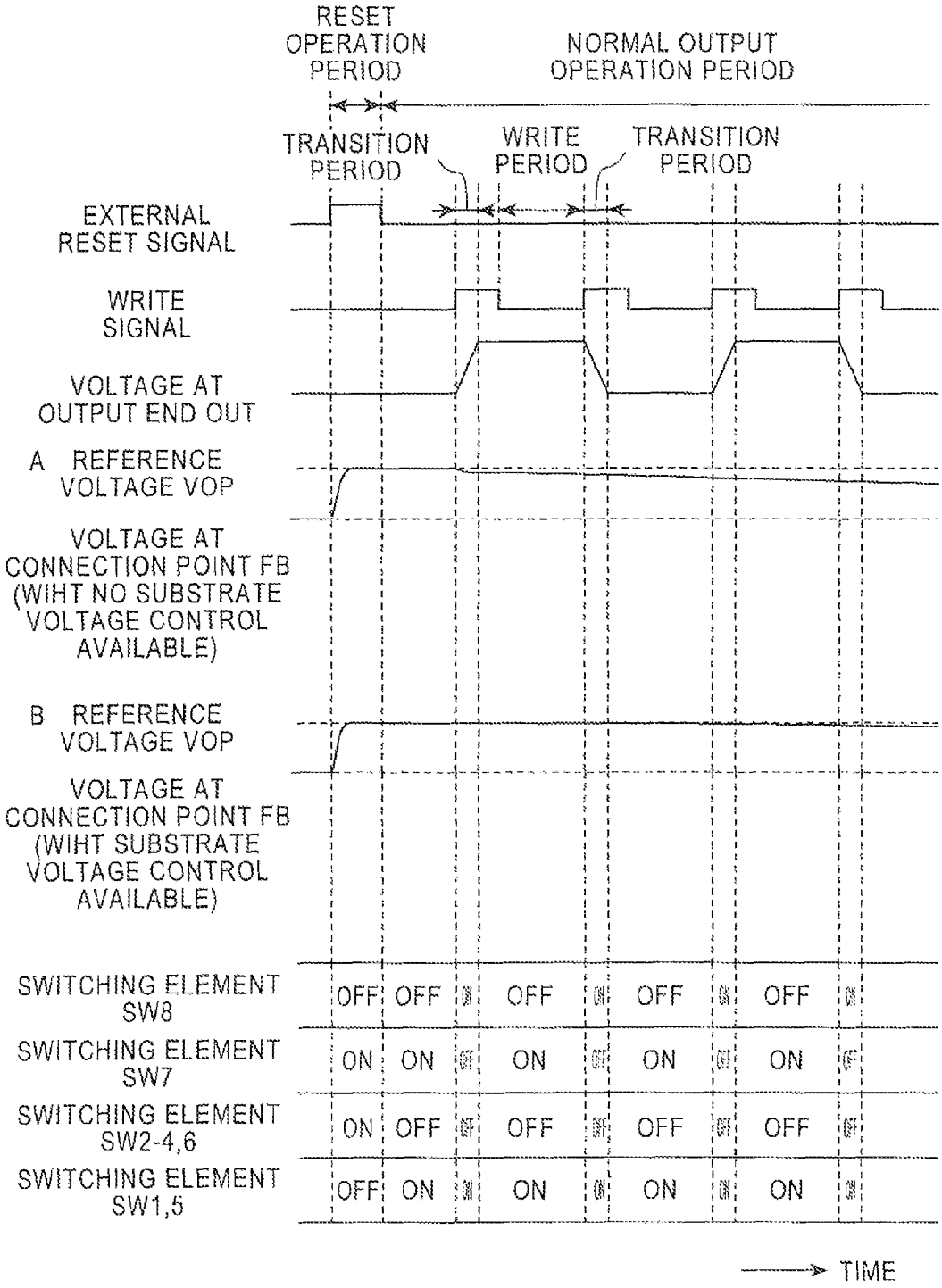
FIG. 10 is a view illustrating changes in voltage of a connection point FB and switching elements being turned ON and OFF in each of the cases with no substrate voltage control available and with substrate voltage control available.

As such, the periods of the switching element SW7 being OFF and the switching element SW8 being ON are shown as a transition period in FIG. 10. During the transition period, the power supply voltage VDD is applied to the substrate of each of the switching elements SW3 and SW4 via the switching element SW8. Thus, it is avoided that a large leakage current flows between the source or the drain and the substrate of each of the switching elements SW3 and SW4. Accordingly, as shown at Portion "B" in FIG. 10, it is possible to prevent the voltage level of the connection point FB from being dropped when the output port OUT changes in voltage.

In this series of operational steps, to prevent leakage current in the switching elements SW3 and SW4, the potential of the control signal CONT is changed at the same time as the substrate potential of the switching elements SW3 and SW4 is changed. That is, the control signal CONT that is supplied to the gates of the switching elements SW3 and SW4 to turn OFF the elements will be at the power supply voltage VDD that is the voltage at the connection point VG. This makes it possible to prevent leakage current from occurring at the switching elements SW3 and SW4 due to changes in the substrate potential of the switching elements SW3 and SW4.

As described above, this embodiment provides the additional switching elements SW7 and SW8 which change over the connection point VG leading to the substrates of the switching elements SW3 and SW4 between the reference voltage VOP and the power supply voltage VDD. This configuration makes it possible to suppress leakage current from the connection point FB to the connection point VG as well as to hold the connection point FB at the reference voltage VOP for a certain period of time, thus minimizing the output voltage offset.

Note that the aforementioned embodiment employed a P-channel FET as a switching element; however, an N-channel FET can also be used. When an N-channel FET is used as a switching element, the substrate of each of the switching element SW3 and the switching element SW4 is supplied with the ground potential VSS instead of the power supply voltage VDD during the transition period in which the voltage VDAC varies in level.

Furthermore, when the voltage VDAC varies in level, the period (the aforementioned predetermined time) in which the switching element SW7 is turned OFF and the switching element SW8 is turned ON may be the time that is required for the output voltage of the output amplifier or the voltage VDAC to finish varying. Alternatively, that period can also be a detected period required for the output voltage of the output amplifier or the voltage VDAC to reach the threshold value that is determined corresponding to the voltage to which the output voltage or the voltage VDAC changes.

Figure 11:
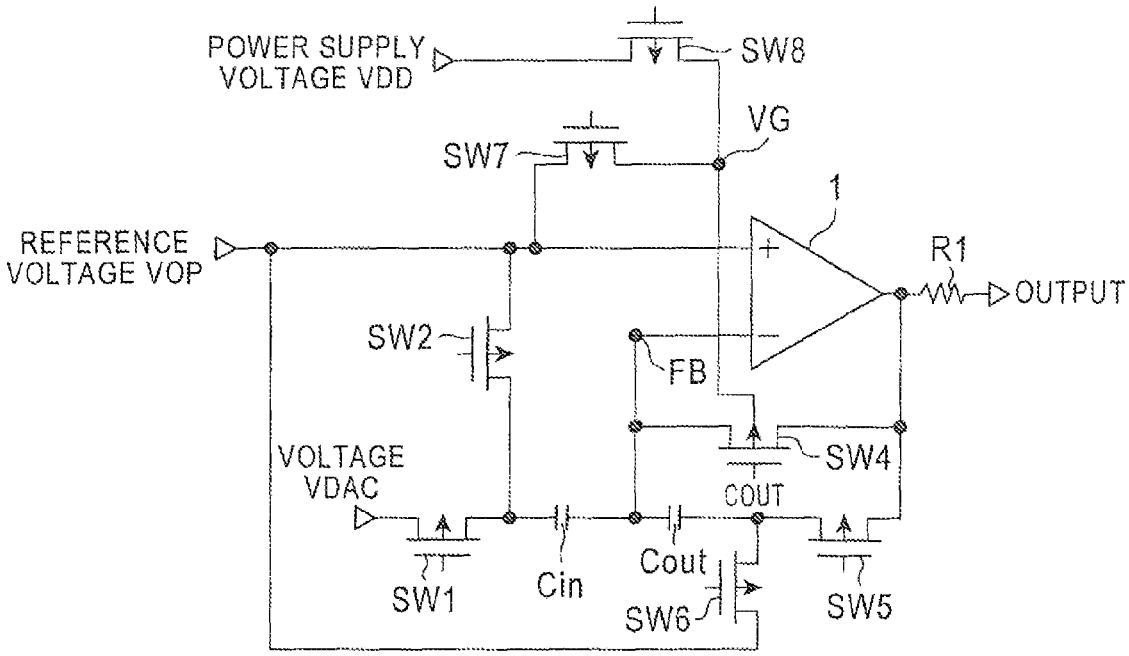
FIG. 11 is a block diagram illustrating the configuration of an offset cancel output circuit according to another embodiment of the present invention.

FIG. 11 shows another embodiment of the present invention. The offset cancel output circuit of FIG. 11 is configured to eliminate the switching element SW3 in the output circuit of FIG. 5. This configuration is the same as that of the circuit shown in FIG. 13 of Patent Literature 1. In the offset cancel output circuit of FIG. 11, a variation in the level of the voltage VDAC during the normal output operation period also causes the switching element SW7 to be turned OFF and the switching element SW8 to be turned ON. The turning OFF of the switching element SW7 and the turning ON of the switching element SW8 cause the power supply voltage VDD to be applied to the substrate of the switching element SW4 via the switching element SW8. This prevents a large leakage current from flowing between the source or the drain and the substrate in the switching element SW4. It is thus possible to prevent drops in voltage level at the connection point FB during a change in voltage at the output port OUT.

Furthermore, the levels of each of the power supply voltage DDD, the reference voltage VOP, the ground potential VSS, and the voltage VDAC have been shown by way of example in the aforementioned embodiments; other voltage levels may also be employed without being limited to the aforementioned voltage levels.

This application is based on Japanese Patent Application No. 2010-210627 which is herein incorporated by reference.

What is claimed is:

1. An offset cancel output circuit of a source driver to which a gray scale voltage corresponding to a gray scale represented by digital data is applied to output a drive voltage to a liquid crystal display panel, the offset cancel output circuit comprising:

an operational amplifier with a reference voltage applied to a non-inverted input port thereof;

an input capacitor and an output capacitor with each one end thereof connected to an inverted input port of the operational amplifier; and a switching element circuit that has a first field effect transistor connected between the inverted input port and an output port of the operational amplifier, wherein the switching element circuit turns ON the first field effect transistor during a reset operation to make a short circuit between the inverted input port and the output port of the operational amplifier and to allow each of the input capacitor and the output capacitor to accumulate an offset voltage, and wherein during a normal output operation after the reset operation, the switching element circuit turns OFF the first field effect transistor, applies the gray scale voltage to the other end of the input capacitor, and connects the other end of the output capacitor to the output port of the operational amplifier, and wherein during the reset operation and the normal output operation, the switching element circuit applies a first potential equal to the reference voltage to a substrate of the first field effect transistor, and when switching the gray scale voltage during the normal output operation, the switching element circuit applies to the substrate a second potential different from the first potential instead of the first potential so as to prevent a leakage current from flowing to the substrate from a source or a drain of the first field effect transistor.

2. The offset cancel output circuit according to claim 1, wherein the switching element circuit has a second field effect transistor which is turned ON during the reset operation to apply the reference voltage to the inverted input port, and during the reset operation and the normal output operation, the switching element circuit applies the first potential to a substrate of each of the first and second field effect transistors, and when switching the gray scale voltage during the normal output operation, applies the second potential instead of the first potential to the substrate so as to prevent a leakage current from flowing to the substrate from the source or the drain of each of the first and second field effect transistors.

3. The offset cancel output circuit according to claim 2, wherein the second potential is equal to a power supply voltage at a level higher than the reference voltage when each of the first and second field effect transistors is a P-channel field effect transistor, and is equal to an ground potential at a level lower than the reference voltage when each of the first and second field effect transistors is an N-channel field effect transistor.

4. The offset cancel output circuit according to claim 2, wherein when switching the gray scale voltage during the normal output operation, a voltage at a level different from the reference voltage is applied to a gate of each of the first and second field effect transistors.

5. The offset cancel output circuit according to claim 3, wherein when switching the gray scale voltage during the normal output operation, a voltage at a level different from the reference voltage is applied to a gate of each of the first and second field effect transistors.

6. The offset cancel output circuit according to claim 1, wherein when switching the gray scale voltage during the normal output operation, the second potential is applied to the substrate for a predetermined period of time.

7. The offset cancel output circuit according to claim 1, wherein when switching the gray scale voltage during the normal output operation, a period of time during which the second potential is applied to the substrate is a period required for the output voltage of the operational amplifier or the gray scale voltage to reach a threshold value that is defined corresponding to a voltage to be reached.

8. An offset cancelling method for an output circuit of a source driver for driving a liquid crystal display, the output circuit including an operational amplifier with a reference voltage applied to a non-inverted input port thereof, an input capacitor and an output capacitor with each one end thereof connected to an inverted input port of the operational amplifier, and a first field effect transistor connected between the inverted input port and an output port of the operational amplifier, the output circuit supplying a gray scale voltage corresponding to a gray scale represented by digital data to output a drive voltage to the liquid crystal display panel, the method comprising:

turning ON the first field effect transistor during a reset operation to make a short circuit between the inverted input port and the output port of the operational amplifier and allowing each of the input capacitor and the output capacitor to accumulate an offset voltage;

turning OFF the first field effect transistor during a normal output operation after the reset operation, applying the gray scale voltage to the other end of the input capacitor, and connecting the other end of the output capacitor to the output port of the operational amplifier;

applying a first potential equal to the reference voltage to a substrate of the first field effect transistor during the reset operation and the normal output operation; and applying a second potential different from the first potential to the substrate instead of the first potential, when switching the gray scale voltage during the normal output operation, so as to prevent a leakage current from flowing to the substrate from a source or a drain of the first field effect transistor.

* * * * *